United States Patent [19]

Blackshear et al.

[11] Patent Number: 4,649,793

[45] Date of Patent: Mar. 17, 1987

[54] HUMIDITY MODIFYING DEVICE FOR GUITARS

[76] Inventors: David A. Blackshear, 29 Birchwood Rd., Mahtomedi, Minn. 55115; Perry L. Blackshear, Jr., Dept. of Mechanical Engineering, University of Minnesota, Minneapolis, Minn. 55455

[21] Appl. No.: 697,170

[22] Filed: Feb. 1, 1985

[51] Int. Cl.[4] ..... G10D 3/00

[52] U.S. Cl. ..... 84/453

[58] Field of Search ..... 84/453

[56] References Cited

U.S. PATENT DOCUMENTS

| | | | |
|---|---|---|---|
| 1,033,536 | 7/1912 | Canfield | 239/44 |
| 3,407,700 | 10/1968 | Hollander | 84/453 |
| 3,721,152 | 3/1973 | Von Meyer | 84/453 |
| 4,024,788 | 5/1977 | Dunlap | 84/267 |

*Primary Examiner*—Lawrence R. Franklin

*Attorney, Agent, or Firm*—Burd, Bartz & Gutenkauf

[57] ABSTRACT

A humidity modifying device for guitars, and similar musical instruments which are susceptible to damage such as cracking, splitting, etc. when subjected to deleterious humidity conditions. Such instruments characteristically have a sound box formed from wood, strings and a sound hole underlying the strings. The humidity modifying device comprises a resilient plug adapted to be disposed in the sound hole with a sealing fit and having a humidity modifying material, such as a moisture retentive sponge-like pad or desiccant cartridge, secured to the inner surface of the plug to maintain desired humidity conditions within the sound box. Preferably the moisture-retentive means or desiccant is retained within a pocket or chamber within the plug by means of a closure plate supported by a flange formed in the bottom surface of the plug.

18 Claims, 5 Drawing Figures

HUMIDITY MODIFYING DEVICE FOR GUITARS

FIELD OF THE INVENTION

1. Background of the Invention

This invention is directed to a humidity modifying device for guitars and similar musical instruments which are susceptible to damage due to exposure to dry conditions. Stringed instruments such as guitars include a sound box assembled from wooden parts and enclosing a resonant cavity. Such instruments are provided with a water impermeable outer finish of lacquer or similar coating material. Such instruments when subjected to intolerable seasonal extremes of humidity develop cracks, joint separation, and the like, requiring costly repairs. Such conditions are particularly prevalent in centrally heated buildings during winter months in cold climates.

2. The Prior Art

Available devices for alleviating the damaging effects of low humidity conditions include containers filled with a water absorbent material which are designed to be most effective when placed inside the instrument case. Because the case is frequently moisture permeable, the devices must be frequently remoistened. None is designed to protect the resonant cavity when the instrument is outside the case. Monitoring of the humidity level is difficult.

Hollander U.S. Pat. No. 3,407,700 discloses a humidifying "snake" in the form of an elongated perforated tubular sheath having a large capacity water absorbent core which is insertable into the interior of an instrument sound box through a resonance hole. Because the device may be placed within the sound box, it is somewhat more effective in raising the humidity within the resonant cavity where it is most needed. However, the sound holes remain open with the result that the added humidity is dissipated rapidly.

Von Meyer U.S. Pat. No. 3,721,152 shows a humidifier attachment for a guitar which comprises a housing supporting a body of porous material containing water adapted to be attached within the housing of the guitar or similar instrument. The sound hole remains open.

Canfield U.S. Pat. No. 1,033,536 discloses a humidifying device intended especially for pianos including a cup supported within the case of the piano and containing a moistened sponge.

SUMMARY OF THE INVENTION

The humidity modifying device of the present invention is intended to overcome the shortcomings of the prior art devices. Broadly stated, it comprises a plug having a configuration corresponding to that of the sound hole of the instrument with which it is intended to be used and dimensioned just slightly larger than those of the sound hole, such that the plug is held in the hole with a sealing fit that greatly reduces moisture loss, and a moisture retentive means secured to the inner surface of the plug. Preferably the plug is formed with a chamber or pocket on its inner surface for housing humidity modifying material, such as moisture retentive means, which is in the form of a water absorptive sponge or foam material, or a desiccant, retained by a perforated metering plate. The humidity modifying device maintains desired humidity levels within the resonant cavity whether the instrument is within or out of its carrying case. When the sealing plug is soft, the moisture content of the sponge can be assessed by gentle pressure. The sealing plug may be formed with an ornamental outer surface. Where desired, the seal may be made of transparent material or may include a transparent window to permit visual monitoring of the state of the humidifier. In instruments which have pickups detecting vibration of the resonant top or soundboard of the instrument, the humidifying device sealing the sound hole serves to minimize feedback.

BRIEF DESCRIPTION OF THE DRAWINGS

The humidifying device of the present invention is illustrated in the accompanying drawings in which corresponding parts are identified by the same numerals and in which.

DETAILED DESCRIPTION OF THE PREFERRED EMBODIMENT

Figure 2:
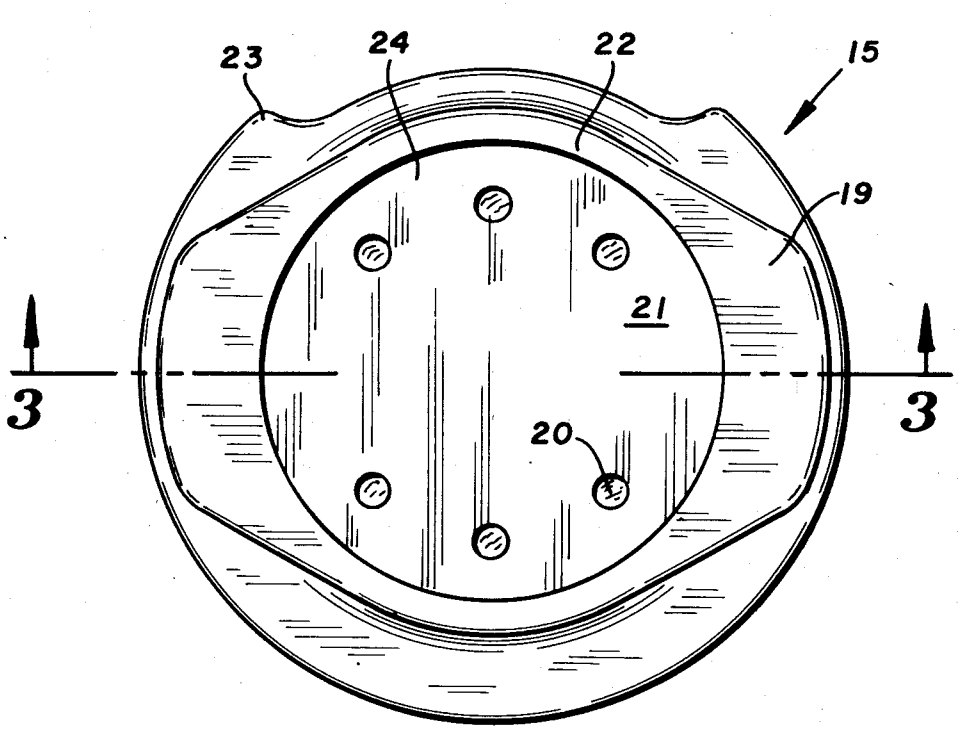
FIG. 2 is a bottom view of the humidifying device on an enlarged scale.

Referring now to the drawings, there is shown a guitar, indicated generally at 10, including a hollow sound box 11 enclosing a resonant cavity or chamber and having a resonance opening or sound hole 12. As is conventional, the guitar also includes a finger board 13. Strings 14 extend from the finger board spaced above the sound hole in the usual manner. A sealing plug, indicated generally at 15, closes the sound hole.

The sealing plug 15 is formed from a resilient or semiresilient rubber or rubber-like synthetic resinous material. A preferred material is polyvinyl chloride plastisol which may be transparent or opaque, as desired. Other exemplary materials include silicone rubber, neoprene, and the like.

Sealing plug 15 is formed with a flat circular disc-like top member 16 whose diameter is slightly larger than that of the sound hole 12 such that the outer periphery of the top member functions as a top flange 17 which overlies the sound box surrounding the sound hole by about $\frac{1}{8}$ to $\frac{1}{2}$ inch. A dependent annular lip 18 extends vertically from the bottom surface of the top member 16. Lip 18 is spaced inwardly from the outer edge of flange 17. Its outside diameter is approximately the diameter of the sound hole such that it fits readily therein and its depth is approximately the thickness of the top of the sound box.

Figure 3:
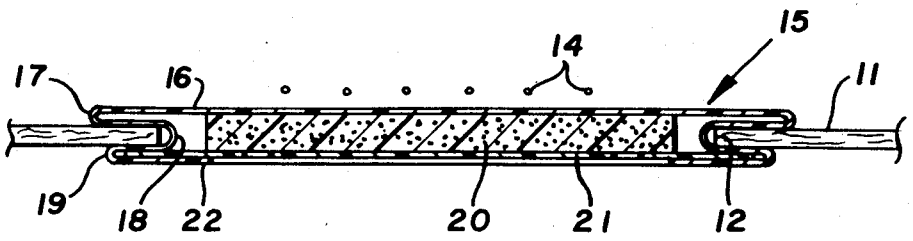
FIG. 3 is a fragmentary section on the line 3—3 of FIG. 2 and in the direction of the arrows, showing details of construction of the humidifying device.

A pair of opposed ear-like bottom flanges 19 extend outwardly from the opposite sides of the bottom edge of the lip 18. The maximum extension of the outer peripheral edges of flanges 19 is greater than the diameter of the sound hole but preferably just slightly less than the diameter of top flange 17 for easy insertion of the plug. Because of the flexibility and resiliency of the material from which plug 15 is formed, the plug is readily deformed to permit the ear-like bottom flange portions to be forced through the sound hole. As seen in FIG. 3, the edge of the sound hole is engaged between flanges 17 and 19 such that the plug 15 effectively seals the opening.

A humidity modifying means, such as a moisture retentive means 20 in the form of a pad of water absorptive sponge or sponge-like synthetic foam material, is disposed on the inside surface of the plug top member 16. The pad 20 may be secured by means of adhesive or the like. Preferably, however, it is held in place in the space within the annular lip by means of a thin flexible perforated disc or plate 21 held in place by means of a further bottom flange 22 extending inwardly from the bottom edge of the lip, and by opposed ears 23 extending into the interior of flanges 19. Although the diameter of disc 21 is greater than the diameter of the opening within flange 22, because of the flexibility and resiliency of the plug 15, the pad and disc are easily inserted. For use in high humidity areas, a cartridge of silica gel or similar desiccant material may be used as the humidity modification means.

The sealing plug 15 is readily formed by dipping a positive mold into a solution of plastisol. When a coating of desired thickness is built up, the resulting plug is stripped from the mold.

The perforations of plate 21 are distributed to allow easy passage from the water retentive means to the perforations. The number and size of the perforations are designed to limit the evaporation rate so that the humidity in the instrument cavity is within the desired range. A preferred configuration is shown in FIG. 2.

Figure 1:
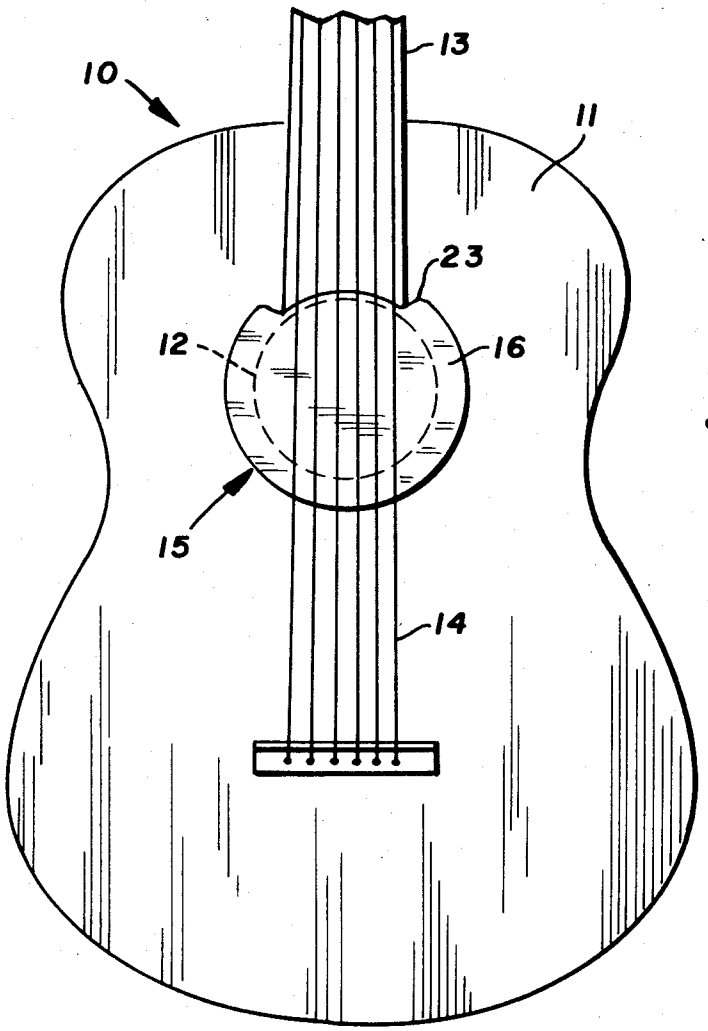
FIG. 1 is a fragmentary top plan view of a guitar provided with one form of humidifying sealing device.

Because the finger board 13 often extends almost to the edge of the sound hole, in order to effect a good seal, it is necessary that a segment of flange 17 of the seal plug top member 16 be removed in order to accommodate the end of the finger board. As seen in FIG. 1 at 24, a gap exists in flange 17 equal to between about 80° to 100° of the periphery of the top member, leaving the maximum width of the flange intact over about 260° to 280° of the periphery of the top member. Because of the slight overlap of the cut away segment of flange 17 with the top surface of the sound box wall, an effective seal remains.

In normal use of the humidifying device, pad 20 is moistened and the sealing plug is flexed sufficiently to force the plug into sealing engagement with the sound hole. Because the instrument is effectively sealed, the wood of the hollow sound box is maintained at desirable levels of moisture content, whether or not the instrument is maintained in a well sealed case. Rewetting of the pad 20 two or three times a month maintains the desired moisture level. This makes possible the avoidance of the most frequent and expensive repairs caused by climatic extremes in humidity. If the instrument fitted with the humidifying device is placed in a well sealed case, then the entire instrument is maintained at the desired level of humidity preserving the finger board as well from the effects of excessively low or rapidly changing humidity conditions. Ideally the relative humidity at the inside surface of the device is at approximately 50 percent. If moisture diffuses out of the instrument body, it is replaced by moisture from the humidifying device. In most climates where a desiccant is used in place of a moisture retentive humidifying means, moisture diffuses into the instrument body, and will be adsorbed by the desiccant. In addition, the device is acoustically functional by minimizing feedback due to shell vibration pickup. It may also function as a mute to alter the sound of the instrument. Although the humidifying device is described with special reference to guitars, it is equally adapted to use in other fretted instruments such as mandolins, lutes, and the like, in which moisture plays an important role.

The principle upon which the humidity regulating device of the present invention is based treats the instrument as a wooden structure enveloped by a vapor barrier, the lacquer or epoxy finish. Thus, a humidifier (or dehumidifier) placed inside the instrument acts to add (or remove) water vapor from the air in the hollow body 11 of the instrument depending on the relative humidity difference between the air in the instrument and the air near the surface of the humidity modifier.

The rate at which water vapor is transferred depends on the magnitude of the vapor pressure difference and the geometry but not the orientation of the humidity modifier when it is fixed in the sound hole. Adding or extracting water vapor will cause the humidity in the instrument to change until the rate of humidity transfer across the vapor barrier (and sound holes if they are open) equals the transfer at the surface of the humidity modifier.

When the instrument containing a humidity modifier is placed in a case, then the final equilibrium will be determined by the transport of vapor across the walls of the case. When the instrument is being used, the transport of vapor across the sound holes is increased. The mass of wood in the instrument acts as a storage of humidity so that when there is no humidity modifier in the instrument, there is a net change in water content of the wood during play when a difference between internal and external relative humidity exists.

The principle of the invention employs a humidity modifier in the form of plug 15 that closes the sound hole while the instrument is idle or during muted use in an effort to provide better humidity control with less frequent attention than is possible with a humidity modifier placed within the instrument with the sound hole open or placed at random within the instrument with the sound hole closed.

Figure 4:
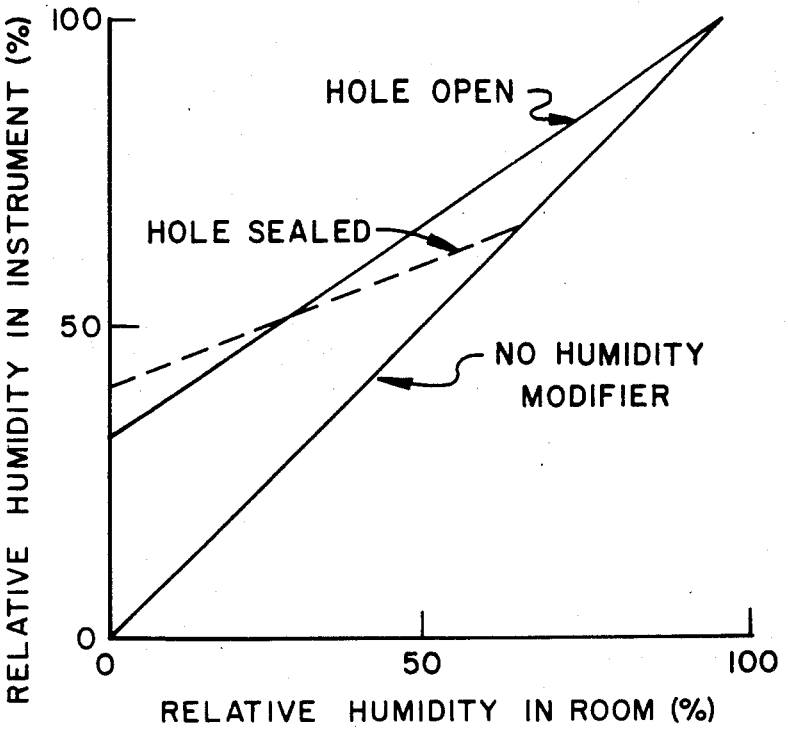
FIGS. 4 and 5 illustrate graphically the behavior effects of humidifying and desiccating systems under varying conditions encountered by guitars.

The first effect of closing the sound hole makes it possible to take advantage of some of the natural changes that occur in wood and finishes to introduce an autoregulation in the behavior of the device-instrument combination which prevents extremes of humidity from occurring within the instrument. The autoregulatory effect is due to the influence of moisture content in the water permeability of various substances: Permeability increases with increasing water content. The net result is that when the humidity modifier is a humidifier and the sole route for moisture to leave the instrument is through the instrument wall, the humidity moderator can maintain the interval relative humidity at an acceptable range over a wider range of external conditions. This effect is shown in FIG. 4 for a humidifier.

When the humidity modifier is used to maintain desired humidity in an instrument in moist climates, the humidity modifier constrains a desiccant and the sealing of the hole is essential if the amount of desiccant is not to be prohibitive.

Figure 5:
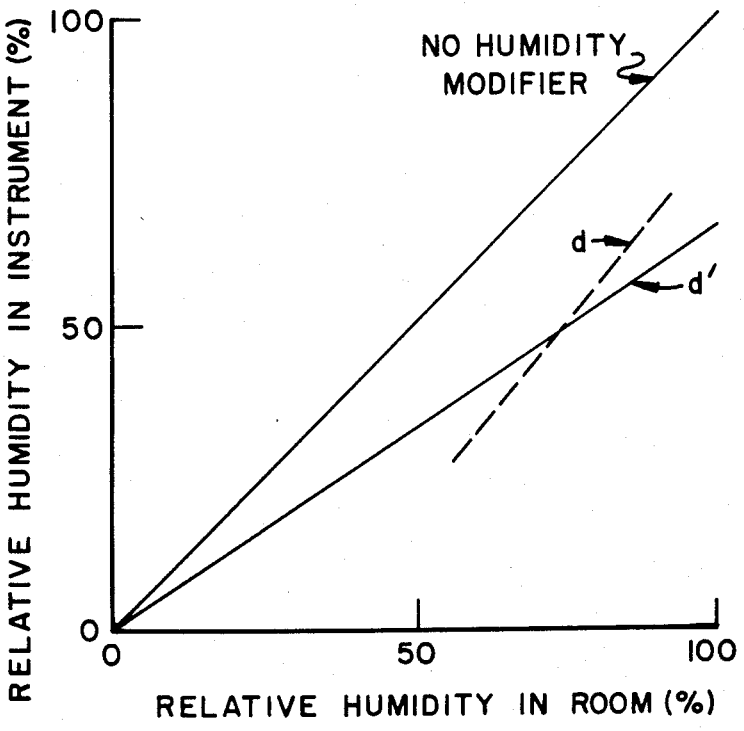

Curve "d" in FIG. 5 is the behavior expected of a system designed for 75 percent RH external environment when the permeability of the instrument's shell is sensitive to RH, but the humidity modifier holes are not. To improve the response, a behavior similar to the behavior of the shell is needed at the desiccant surface.

Thus, shallow paper blisters over the apertures in the shell restraining the desiccant should provide the behavior shown in curve "d". (This behavior can also be obtained by screens which keep the desiccant away from the apertures that are in turn covered with a paper membrane.) When used in this drying capacity, the device should be dehydrated daily.

An additional utility of the present invention in protecting the instrument in a humid climate is in minimizing damage due to sudden changes in humidity. Because wood is viscoelastic, i.e., it can flow as well as elastically deform, greater swings in humidity and the resulting volume changes can be tolerated without crack formation if the changes occur gradually than if they occur so fast that large stresses can build. For example, taking a guitar from the trunk of a car on a hot humid day into an air conditioned space and opening the case to 50 percent RH air can cause a 50 percent reduction in absorbed water in a short time if the sound hole is not closed.

Fixing the humidity modifier in the sound hole at the boundary of the instrument means that part of the heat exchanged in evaporation or condensation is with the room air. This is expected to promote free convection inside the instrument. In addition, a phase change humidity modifier free to assume many positions inside the instrument should have as many vaporization rates as positions. In addition, most of the heat would be expected to come from the air in the instrument and lead to stagnant conditions when the humidity modifier is a humidifier.

MASS TRANSFER CONSIDERATIONS FOR THE PREFERRED EMBODIMENT

In order to achieve an internal relative humidity that is between humidity of the humidity modifier surface and of the surroundings, it is required that the mass transfer coefficient times the area of the humidity source be in a narrow range with respect to the permeability times the surface area of the instrument. This requires a determination of the water flux across the instrument surfaces and at the surface of the humidity moderator in response to relative humidity gradients. Because the temperature is so nearly constant throughout, these gradients may be safely treated as vapor pressure gradients.

CUP METHOD

Water movement by both the dry cup and wet cup methods were measured over a period of one winter in lacquer finished and epoxy finished solid guitar tops. In both cases, the cup was placed on the finished side of the wood and where possible not aligned with an interior brace. In both cases the wood was 3 mm thick.

The values obtained are a PERM of 200 ng/m$^2$ s $P_a$ for the lacquer and 80±10 ng/m$^2$ s $P_a$ for the epoxy finished surfaces in the wet cup tests and slightly lower for the dry cup tests. In both cases the relative humidity in the guitar was 50 percent±2 percent. Tabulated values of permeability for a 3 mm thick sheet of pine ranges over $193 \leqq \text{PERM} \leqq 2600$. The results above suggest that the surface finish plays an important role. A lacquer finished guitar with a surface area of ca 0.5 m$^2$ was instrumented in such a way that the average permeability could be determined while maintaining internal relative humidity at 45 degrees while the surroundings remained at 30 percent. Here the average permeability was measured at 74 ng/m$^2$ s $P_a$. Thus, a lower limit of water addition over a 24 hour period as 1 g/day if the humidity modifier is kept in place and higher if played vigorously with the sound hole open. These experiments determine that the humidity source must contain enough water for the duration desired and the hole size and spacing must be sufficient to permit 1 g/day evaporation with a driving vapor pressure difference of ca 1500 $P_a$.

HOLE SIZES AND DISTRIBUTION ON HUMIDIFIER SURFACE

Preliminary calculations of arrays of hole sizes showed that no regulatory advance could be gained by closely spaced hole arrays and that to assure loss of access from the reservoir it was desirable to have uniform spacing. Practical matters of die cutting also entered. These calculations suggested that four 6.35 mm holes (¼") centered over gradients of the reservoir would provide the required mass transfer rate.

Devices were built and tested in a climate controlled cabinet, as well as in the instrument/guitar, and found to give the mass flow rate predicted. In order to allow for contingencies which include daily use with sound hole open, extraordinarily dry conditions, leaky guitar finishes, etc., an extra pair of holes is added.

RESERVOIR SIZE

A reservoir that can hold a one week's supply of water was thought to be a desired design objective. In order to provide a factor of safety a reservoir that can provide 17 g of water has been selected. The dimensions of this reservoir also permit 25 g of desiccant to be stored. With the mass transfer considerations above and estimating effective $H_2O$ storage as 15 percent of the desiccant weight, there is a capacity of 3.75 g $H_2O$ or two days of dehydration between recharges: the same holes should suffice but more would be needed if paper membranes are added.

TRANSIENT BEHAVIOR

In one series of experiments, an instrumented guitar was allowed to start dehydrating after 18 days of stable hydration at 45 percent relative humidity. Because the moisture loss from the humidifier had been measured on a daily basis and equated to the mass loss from the guitar, it was possible to infer the water stored in the wood of the guitar's interior from the rate of RH change with time. This quantity yields 70 g of water stored at a RH of 45 percent. Since at 45 percent RH it is expected that seasoned wood would have a water content of 8 percent, the amount of wood rapidly exchanging is estimated to be 938 g. If the area is 0.5 m$^2$, this mass represents approximately (at a specific gravity of 0.5) an average thickness of 0.375 cm.

This means that a guitar initially at, say 50 percent relative humidity will lose 79−65=14 g of water in drying from 50 percent to 40 percent RH. If the hole is closed even without an alternative water source, the guitar should be safe from dehydration for 10 days. With the hole open, it should approach room conditions in ca 1 day.

Conversely, a neglected guitar that is dehydrated would be restored gradually to a desired water content with the limited access to water attended by the proposed humidifier and therefore avoid the stress of a suddenly increased humidity offered by a humidifier with a more rapid rate of moisture release.

Conversely, a guitar equilibrated at 45 percent relative humidity and stored (with a humidity modifying plug 15 in place) in a perfectly sealed guitar case would achieve a relative humidity of 53 percent after the 17 g of water in the humidifier had equilibrated with the accessible wood in the guitar body. There does not seem to be a risk in overhumidification in well sealed storage with a single filling of the humidifying reservoir.

The moisture pervious closure plate 21 is designed so the guitar with an average finish in respect to moisture permeability will have its internal humidity roughly half way between room humidity and saturation at room temperature as shown in FIG. 4. This is done by controlling the rate of evaporation from the sponge by the size and number of perforations in the closure. In order to obtain this design data, water flux through a large number of guitars and vaporization rates from sponges faced by plates with an assortment of holes were measured. Ideally the rate of vaporization from the sponge 20 is equal to the rate of moisture flux through the guitar walls when the humidity is at the desired level in the guitar. When this level is too low, moisture is added at a faster rate than it is lost and vice versa. This control is through the size and number of the holes. Optionally the moisture pervious closure plate 21 restricts evaporation to about 1 g/day when the internal relative humidity is 50 percent. The moisture permeable closure plate similarly restricts moisture adsorption when the device is filled with desiccant.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A humidity modifying device for guitars, and similar musical instruments susceptible to deleterious humidity conditions, having a sound box, strings and a sound hole in the box underlying the strings, said device comprising:

(A) a plug having a configuration corresponding to that of the sound hole of the instrument and dimensions just slightly larger than those of the sound hole, whereby the plug may be held in the hole with a sealing fit, said plug including:

(1) a flat circular disc-like top member having a diameter greater than the diameter of the sound hole of the instrument, the outer periphery of said top member comprising a top flange, (2) an annular lip depending from the inside surface of said top member spaced inwardly from the outer periphery of the top member, (a) the depth of said lip being approximately the thickness of the top of the sound box, and (b) the diameter of the outer periphery of the lip being approximately the diameter of the sound hole, (3) a bottom flange extending outwardly from at least part of the bottom edge of the lip, the diameter of the outer periphery of the flange being greater than the diameter of the sound hole but less than the diameter of the top member, and (4) a further bottom flange extending inwardly from the bottom edge of said lip, and (B) humidity modifying material secured to the inner surface of the plug, (1) said humidity modifying material being disposed in the space within said annular lip, and (2) a moisture pervious closure plate being supported on the inside surface of said further inwardly extending bottom flange.

2. A humidity modifying device according to claim 1 wherein said humidity modifying material is a moisture retentive means.

3. A humidity modifying device according to claim 2 wherein:

(A) said plug is formed from resilient or semiresilient rubber or rubber-like synthetic resinous material, and (B) said moisture retentive means is a pad of sponge or sponge-like synthetic foam material.

4. A humidity modifying device according to claim 1 wherein:

(A) said humidity modifying material is a moisture retentive means, and (B) said moisture pervious closure plate restricts evaporation to about 1 g/day when the internal relative humidity is 50 percent.

5. A humidity modifying device according to claim 1 wherein said humidity modifying material is a desiccant.

6. A humidity modifying device according to claim 1, wherein:

(A) said humidity modifying material is a desiccant, and (B) said moisture permeable closure plate restricts moisture adsorption to about 1 g/day when the internal relative humidity is 50 percent.

7. A humidity modifying device according to claim 1 wherein said humidity modifying material is a moisture retentive means in the form of a disc disposed in the space within said annular lip.

8. A humidity modifying device according to claim 1 wherein:

(A) said outwardly extending bottom flange includes a pair of oppositely disposed ear-like flange segments, and (B) said closure plate is a circular disc having a pair of oppositely disposed ear-like extensions engaging the inside of the corresponding flange segments.

9. A humidity modifying device according to claim 1 wherein a further bottom flange extends inwardly from the bottom edge of said lip.

10. A humidity modifying device according to claim 9 wherein the maximum width of the top flange extends around only about 260° to 280° of the periphery of the top member.

11. A humidity modifying device for guitars, and similar musical instruments susceptible to deleterious humidity conditions, having a sound box, strings and a sound hole in the box underlying the strings, said device comprising:

(A) a plug formed from resilient or semi-resilient rubber or rubber-like synthetic resinous material, said plug including (1) a flat circular disc-like top member having a diameter greater than the diameter of the sound hole of the instrument, the outer periphery of said top member comprising a top flange, (2) an annular lip depending from the inside surface of said top member spaced inwardly from the outer periphery of the top member, (a) the depth of said lip being approximately the thickness of the top of the sound box, and (b) the diameter of the outer periphery of the lip being approximately the diameter of the sound hole, (3) a bottom flange extending outwardly from at least part of the bottom edge of the lip, the diameter of the outer periphery of the bottom flange being greater than the diameter of the sound hole but less than the diameter of the top flange, and (4) a further bottom flange extending inwardly from the bottom edge of said lip, (B) a humidity modifying material disposed in the space within said annular lip, and (C) a closure plate supported on the inside surface of said further bottom flange.

12. A humidity modifying device according to claim 11 wherein said humidity modifying material is a moisture retentive means.

13. A humidity modifying device according to claim 12 wherein said humidity modifying material is a moisture retentive means formed from a pad of sponge or sponge-like synthetic foam material.

14. A humidity modifying device according to claim 11 wherein said humidity modifying material is a desiccant.

15. A humidity modifying device according to claim 11 further characterized in that said closure plate is a thin moisture pervious disc.

16. A humidity modifying device according to claim 11 wherein:

(A) said outwardly extending bottom flange includes a pair of oppositely disposed ear-like flange segments, and (B) said closure plate is a circular disc having a pair of oppositely disposed ear-like extensions engaging the inside of the corresponding flange segments.

17. A humidity modifying device according to claim 11 wherein the maximum width of the top flange extends around only about 260° to 280° of the periphery of the top member.

18. A humidity modifying device according to claim 11 wherein said plug is formed from polyvinyl chloride plastisol.

* * * * *

UNITED STATES PATENT AND TRADEMARK OFFICE

CERTIFICATE OF CORRECTION

PATENT NO. : 4,649,793

DATED : March 17, 1987

INVENTOR(S) : David A. Blackshear et al

It is certified that error appears in the above-identified patent and that said Letters Patent is hereby corrected as shown below:

On the Title Page, Item [76]

In the heading, the following joint inventors are added:

Stephen J. Kayser, 5122 Hiawatha Avenue, Minneapolis, Minn. 55417; Michael F. Hoey, 1549 Sherwood Road, Shoreview, Minn. 55112.

Column 6, line 8, "advance" should be --advantage--.

Signed and Sealed this

Nineteenth Day of April, 1988

*Attest:*

DONALD J. QUIGG

*Attesting Officer*

*Commissioner of Patents and Trademarks*